US008939785B2

(12) United States Patent
Chiu

(10) Patent No.: US 8,939,785 B2
(45) Date of Patent: Jan. 27, 2015

(54) CABLE CONNECTOR WITH SPRING-LOADED PLUNGER AND ASSEMBLY THEREOF

(71) Applicant: GT Contact Co., Ltd., New Taipei (TW)

(72) Inventor: Jui-Jung Chiu, Taoyuan County (TW)

(73) Assignee: GT Contact Co., Ltd., New Taipei (TW)

( * ) Notice: Subject to any disclaimer, the term of this patent is extended or adjusted under 35 U.S.C. 154(b) by 216 days.

(21) Appl. No.: 13/645,434

(22) Filed: Oct. 4, 2012

(65) Prior Publication Data

US 2014/0099838 A1 Apr. 10, 2014

(51) Int. Cl.
*H01R 4/50* (2006.01)

(52) U.S. Cl.
USPC ..... 439/347; 439/333

(58) Field of Classification Search
USPC ..... 439/347, 348, 333, 823
See application file for complete search history.

(56) References Cited

U.S. PATENT DOCUMENTS

| | | | | |
|---|---|---|---|---|
| 4,758,177 | A * | 7/1988 | Herron | 439/348 |
| 4,834,663 | A * | 5/1989 | Kahl | 439/132 |
| 4,838,804 | A * | 6/1989 | Banjo et al. | 439/325 |
| 5,902,145 | A * | 5/1999 | Hyzin | 439/348 |
| 6,761,469 | B2 * | 7/2004 | Wu | 362/655 |
| 7,785,144 | B1 * | 8/2010 | Islam | 439/583 |

* cited by examiner

*Primary Examiner* — Hien Vu
(74) *Attorney, Agent, or Firm* — Li & Cai Intellectual Property (USA) Office

(57) ABSTRACT

A cable connector with spring-loaded plunger comprises a sleeve and a plunger module. The sleeve is a hollow cylinder with two open ends and formed with a spring bore portion. The plunger module is disposed in the spring bore portion and comprises a plunger slidably disposed in the spring bore portion. The plunger partially penetrates the spring bore portion toward the center of the sleeve. One end of the sleeve thickens inwardly to form a plug connector retaining portion. The cable connector with spring-loaded plunger can effectively decrease the rate of unit aging in connection and disconnection.

6 Claims, 8 Drawing Sheets

CABLE CONNECTOR WITH SPRING-LOADED PLUNGER AND ASSEMBLY THEREOF

BACKGROUND

1. Field of the Invention

The instant disclosure relates to a cable connector; in particular, to a cable connector with spring-loaded plunger and an assembly thereof 2. Description of Related Art Conventional cable connectors often use a threaded female portion to mate with a threaded male portion to connect adjacent sections and provide a cable passage. The threaded portions are fixed on the connector and the fitting relies solely on the engagement between the threaded portions of the leading and trailing ends.

However, the direct contact of threaded portions may cause the serrated teeth worn out after a period of time which leads to loose fitting. The exposed fitting is also prone to corrosion and external damage, therefore shortening the cable connector operation life-expectancy. Hence a cable connector which can decrease the rate of unit worn out and be resistant to corrosion is in great need.

To address the above issues, the inventor strives via associated experience and research to present the instant disclosure, which can effectively improve the limitation described above.

SUMMARY OF THE INVENTION

The object of the instant disclosure is to provide a cable connector with spring-loaded plunger which can effectively decrease the rate of unit worn out.

The cable connector with spring-loaded plunger comprises a sleeve formed with a spring bore portion and a plug connector retaining portion at one end. The cable connector with spring-loaded plunger also comprises a plunger module disposed in the spring bore portion. The plunger module includes a plunger movably disposed in the spring bore portion and the plunger penetrating toward the centre of the sleeve to form a protrusion.

The instant disclosure also provides a spring loaded cable connecter assembly which comprises a sleeve, a plunger module and a receptacle connector. The sleeve is formed with a spring bore portion and a plug connector retaining portion at one end. The plunger module is disposed in the spring bore portion and includes a plunger movably disposed in the spring bore portion. The plunger partially penetrating toward the centre of the sleeve to form a protrusion. The receptacle connector includes a front end with at least one cable aperture. The exterior of the receptacle connector includes a nut retaining portion, a plunger retaining portion abutting the plunger, a receptacle threaded portion that receives a nut and a water proof gasket.

Preferably, the spring bore portion is a through-hole structure to accommodate the plunger module.

Preferably, the plunger module further includes an elastic member and a lid. The plunger has a column portion which stretches towards the opposite end of the protrusion. A disc defines the boundary between the column portion and the protrusion and is flanked by the plunger retaining portion and the elastic member. The spring bore portion is sealed by the lid which also contacts the elastic member.

Preferably, the plunger retaining portion further includes a projected assembly positioning portion and a groove. The assembly positioning portion has a rotation stopper and a locking detent.

The instant disclosure effectively decreases the rate of unit worn out caused by close contact, thus prolonging the operation life-expectancy of the cable connector. The water proof gaskets expel fluid entry and enhance the sealing of the connector.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

Figure 1:
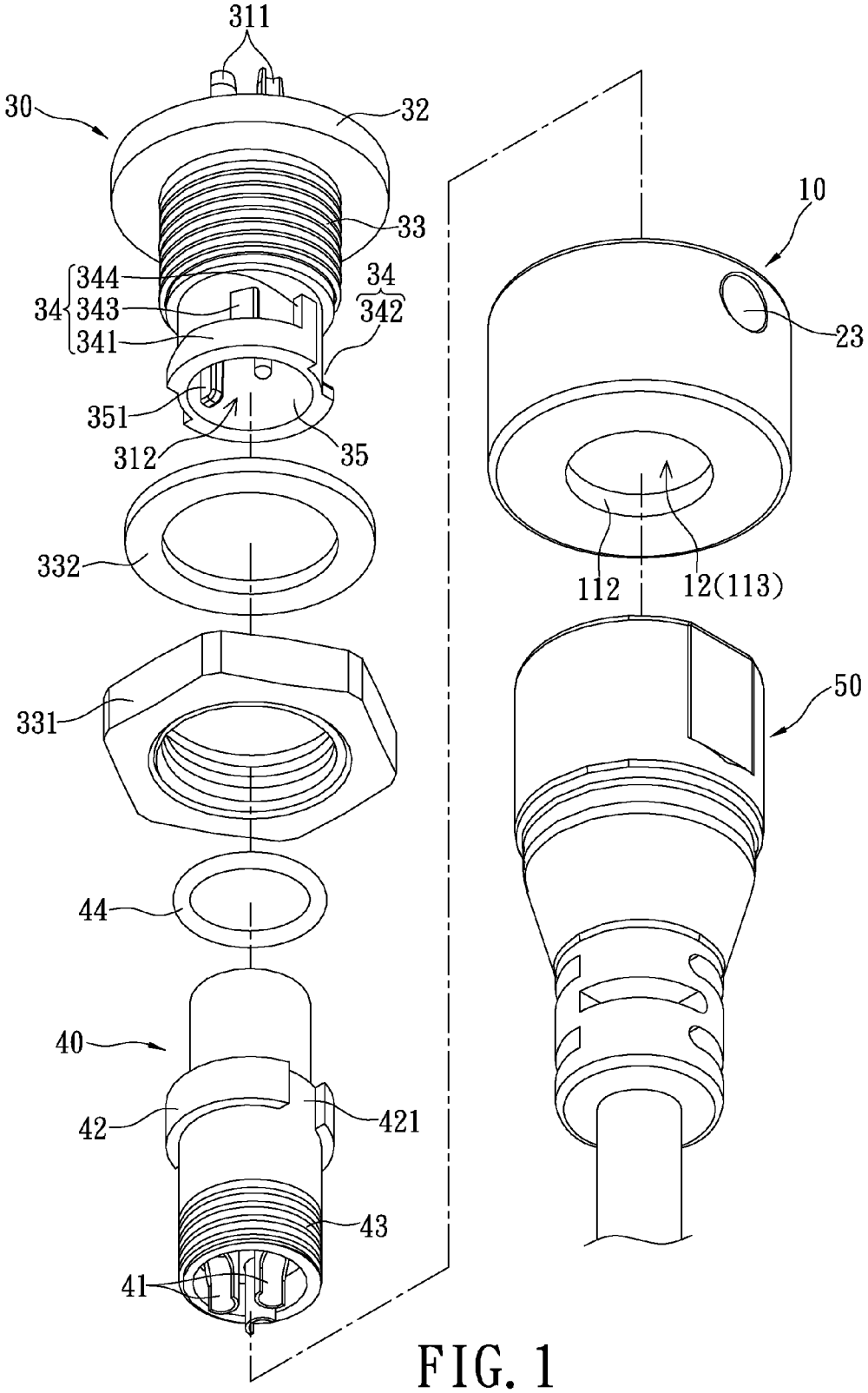
FIG. 1 illustrates a bottom-view exploded diagram of a spring loaded connector assembly in accordance with an embodiment of the instant disclosure.
Figure 2:
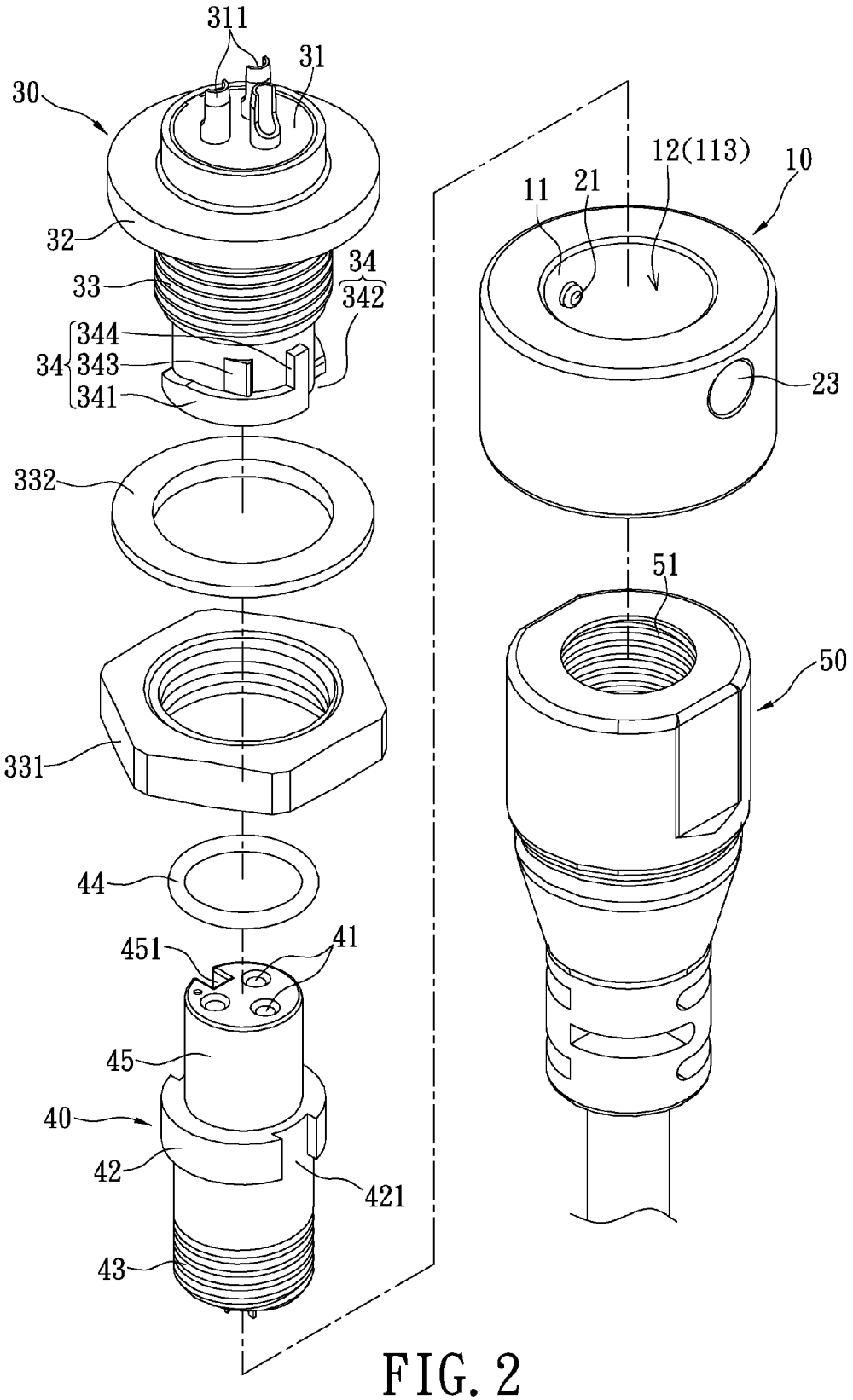
FIG. 2 illustrates a top-view exploded diagram of a spring loaded connector assembly in accordance with an embodiment of the instant disclosure.
Figure 3A:
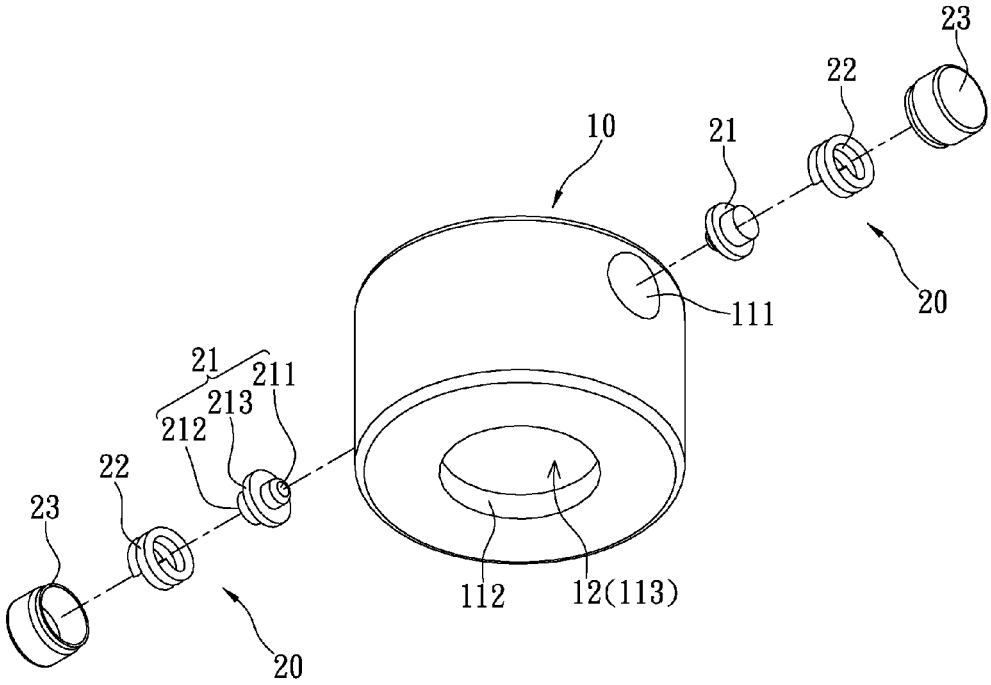
FIG. 3A illustrates a bottom-view exploded diagram of a sleeve of a spring loaded connector assembly in accordance with an embodiment of the instant disclosure.
Figure 3B:
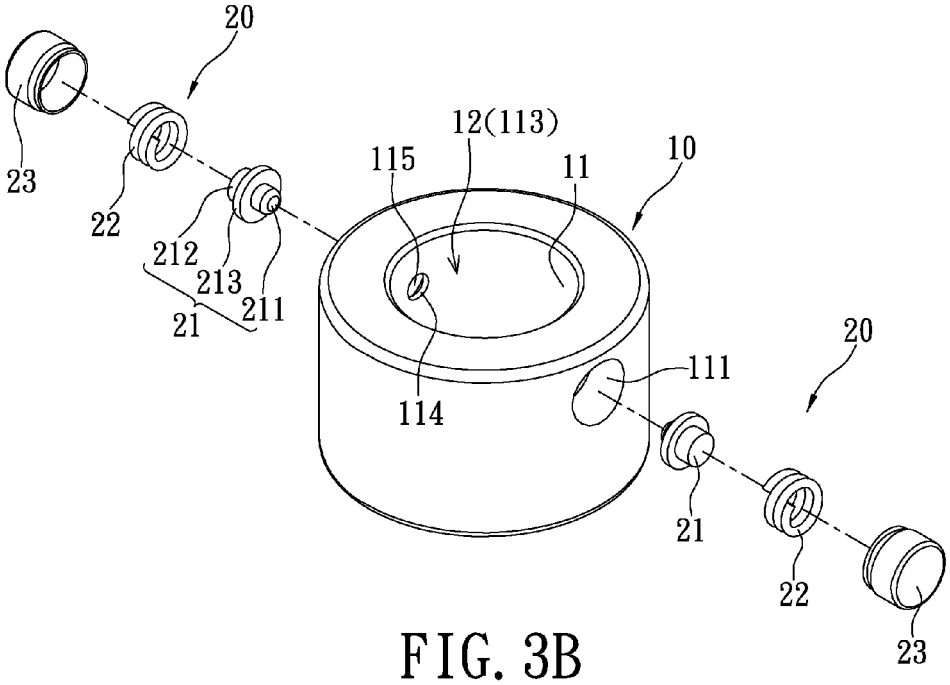
FIG. 3B illustrates a top-view exploded diagram of a sleeve of a spring loaded connector assembly in accordance with an embodiment of the instant disclosure.
Figure 5:
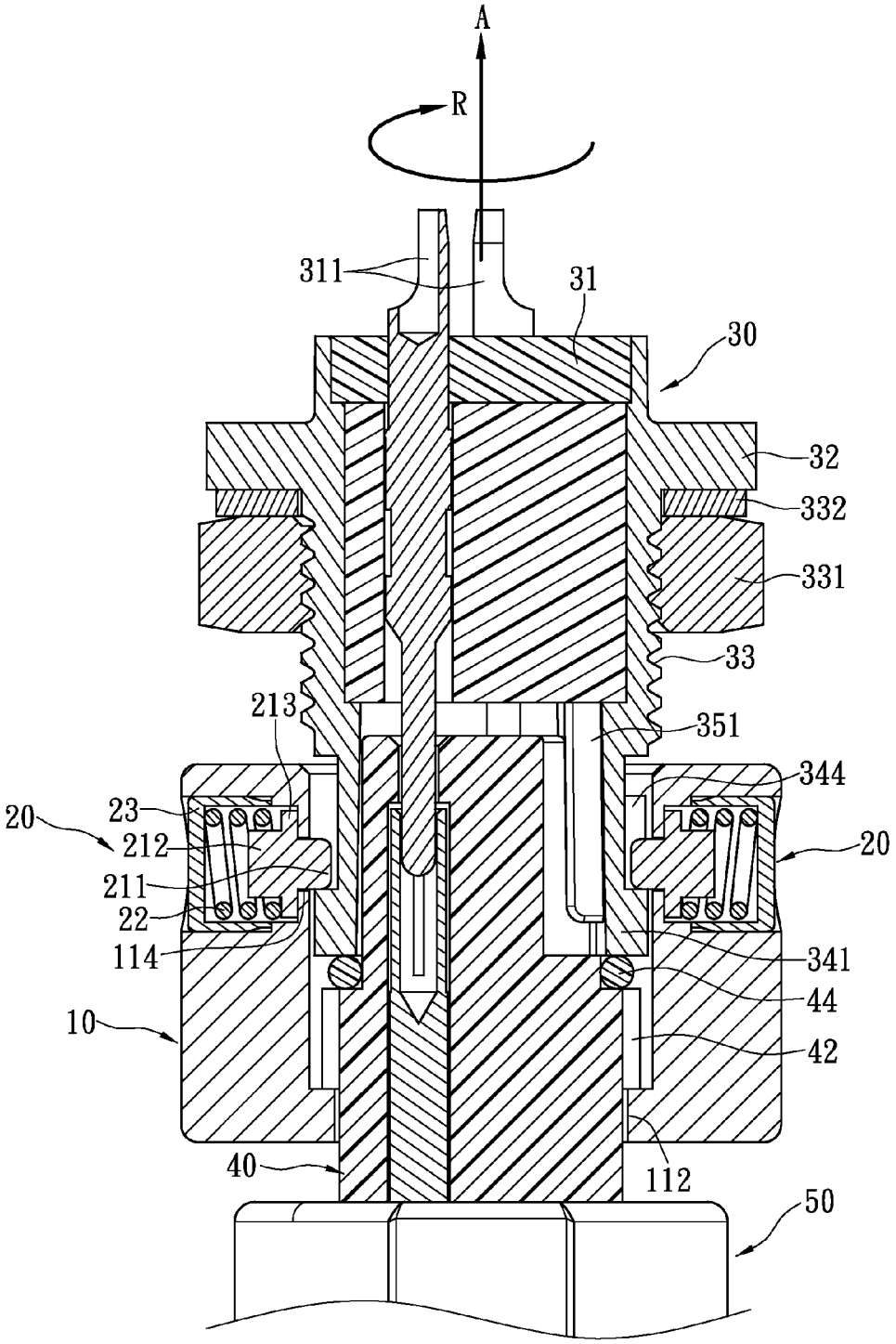
FIG. 5 illustrates a side cross-sectional view of a spring loaded connector assembly in accordance with an embodiment of the instant disclosure.

Please refer to FIGS. 1, 2, 3A, 3B and 5 illustrating a cable connector with spring-loaded plunger in accordance with the instant disclosure. The cable connector with spring-loaded plunger comprises a sleeve 10 and a plunger module 20. The sleeve 10 is a hollow cylinder with two open ends and an inner wall 11. The inner wall 11 is formed with a spring bore portion 111 to accommodate the plunger module 20. The plunger module 20 includes a plunger 21 movably disposed in the spring bore portion 111. Meanwhile, a protrusion 211 of the plunger 21 slightly projects toward the centre of the sleeve 10. One end of the sleeve 10 thickens inwardly to form a plug connector retaining portion 112.

An inner wall retaining portion 114 is formed on the boundary of the spring bore portion 111 and a sleeve hole 12 and the inner wall retaining portion 114 also defines an inner wall opening 115.

The plunger module 20 further includes an elastic member 22 and a lid 23. The elastic member 22 is preferable a spring yet not limited thereto. A column portion 212 projects from the plunger 21 toward the opposite direction of the protrusion 211 and holds the elastic member 22. A disc 213 of the plunger defines the boundary between the protrusion 211 and column portion 212. Additionally, the disc 213 abuts the spring bore portion 111 at one side while the elastic member 22 at the other side. The elastic member 22 is confined by the disc 213 and the lid 23 and provides the resiliency to the plunger 21 in the spring bore portion 111. In other words, the protrusion 211 retracts to the spring bore portion 111 when pressed by a force, whereas relaxed toward the centre of the sleeve 10 when released (i.e. the elastic member 22 provides the compressive force).

When the plunger 21 and the elastic member 22 are disposed in the spring bore portion 111, the lid 23 securely seals the spring bore portion 111.

Figure 4A:
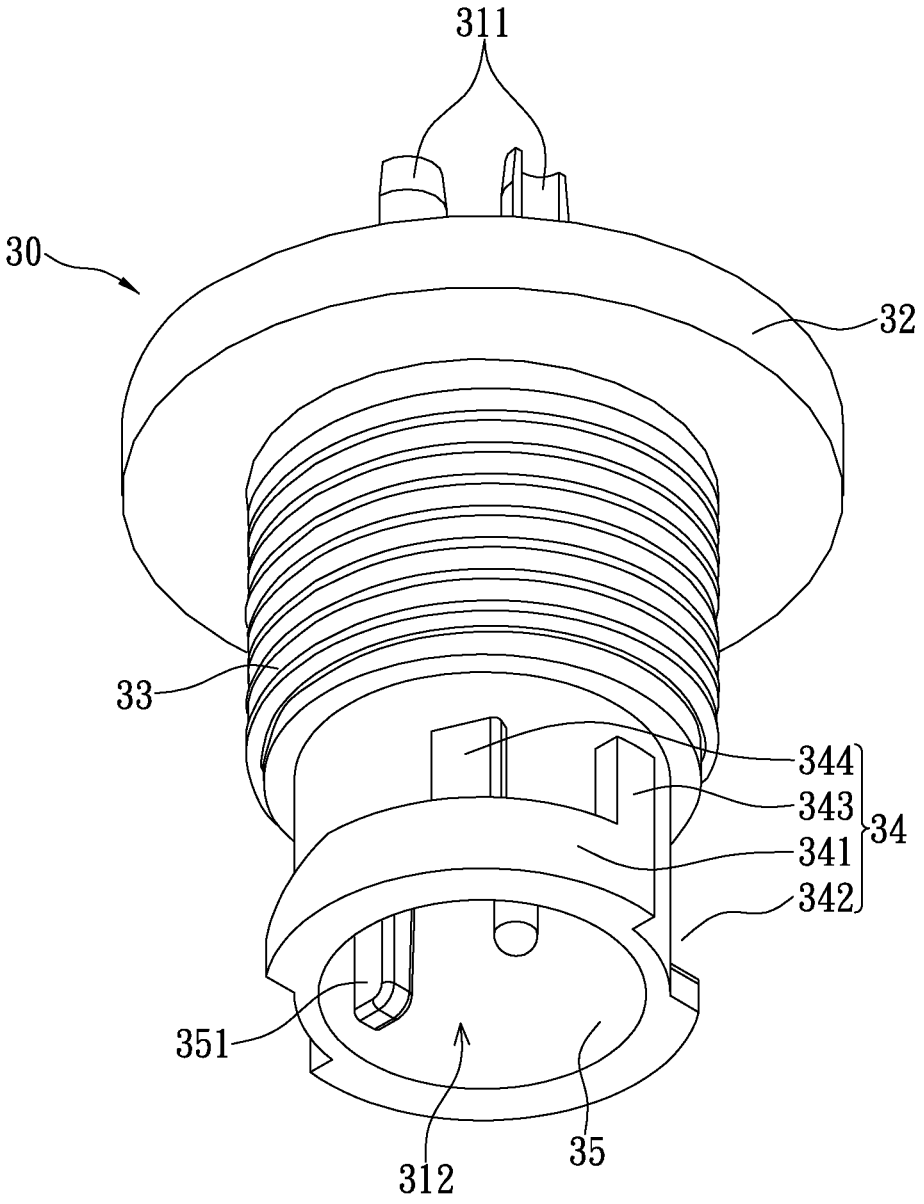
FIG. 4A illustrates a bottom-view exploded diagram of a receptacle connector of a spring loaded connector assembly in accordance with an embodiment of the instant disclosure.
Figure 4B:
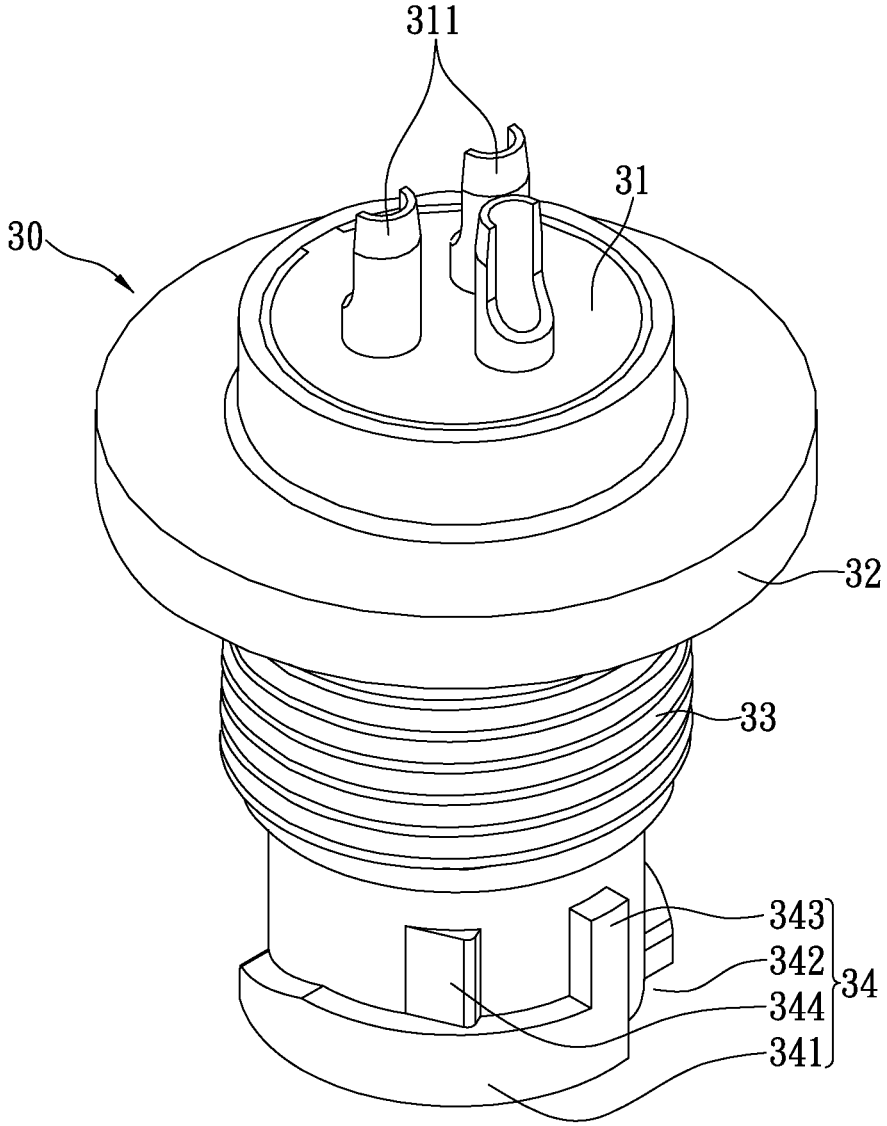
FIG. 4B illustrates a top-view exploded diagram of a receptacle connector of a spring loaded connector assembly in accordance with an embodiment of the instant disclosure.

Please refer to FIGS. 1, 2, 4A, 4B and 5. The instant disclosure further provides a cable connector with spring-loaded plunger assembly. In addition to the sleeve 10 and the plunger module 20, the spring loaded connector assembly comprises a receptacle connector 30. The receptacle connector 30 includes a front end 31 with at least one cable aperture 311. The exterior of the receptacle connector 30 is formed with a nut retaining portion 32, a receptacle threaded portion 33 and a plunger retaining portion 34. The receptacle connector 30 defines a second receiving space 312 therein. The receptacle threaded portion 33 conforms to a nut 331 and a water proof gasket 332. The plunger retaining portion 34 conforms to the plunger 21 of the plunger module 20. The cable aperture 311 communicates with the second receiving space 312.

The receptacle connector 30 along with the water proof gasket 332 can engage on a partition (not shown in the figure). The water proof gasket 332 is in between the nut retaining portion 32 and the partition while the receptacle threaded portion 33 and the plunger retaining portion 34 are at the other side of the partition. The nut 311 goes forward along the receptacle threaded portion 33 toward the nut retaining portion 32 and tightly engages the nut retaining portion 32, water proof gasket 332 and partition. Thus, the water proof gasket 332 can prevent water entry from the joint.

For clarity, the partition is omitted in the following description and the connection relationship among the members is disclosed. The plunger retaining portion 34 further has an assembly positioning portion 341 and a groove 342. A rotation stopper 343 and a locking detent 344 stretch from the assembly positioning portion 341 toward the first threaded portion 33. To engage the sleeve 10 and the receptacle connector 30, the receptacle connector 30 rotates along a direction R to receive the disc 213 of the plunger 21 by the groove 342. Once the disc 213 rests in the groove 342, the sleeve 10 can access the receptacle connector 30 for further engagement.

The receptacle connector 30 continues to rotate along the direction R and then the locking detent 344 contacts the protrusion 211. The locking detent 344 applies a force to the protrusion 211 (i.e. the plunger 20) and the protrusion 211 retracts back to the spring bore portion 111 accordingly to enable the plunger 20 passing over the locking detent 344. As soon as the plunger 20 crosses the locking detent 344, the protrusion 211 immediately flexes back to the original position. The plunger 20 is therefore locked between the rotation stopper 343 and the locking detent 344. In other words, the movement of the receptacle connector 30 is confined by the plunger 20.

Preferably, a plug connector 40 mates with the receptacle connector 30. The plug connector 40 includes at least one cable passage 41 communicating with the cable aperture 311. The plug connector 40 also includes a ring portion 42, a plug threaded portion 43 and a plug front end 45 with a slot 451. The ring portion 42 is received by the plug connector retaining portion 112 of the sleeve 10. A plug connector water proof gasket 44 is arranged on the ring portion 42. Upon complete insertion of the plug connector 40 to the receptacle connector 30, the plug connector water proof gasket 44 is flanked by the assembly positioning portion 341 and the ring portion 42.

Preferably, the slot 451 mates with a connector protrusion 351 of the receptacle connector 30. The protrusion 351 conforms to the slot 451 to ensure correct engagement between the plug connector 40 and the receptacle connector 30. Additionally, because the connector protrusion 351 is locked in the slot 451, the receptacle connector 30 brings along the plug connector 40 in each movement.

Preferably, the ring portion 42 has a nick 421 to allow enough space for the protrusion 211 passing through. That is to say, the protrusion 211 crosses over the ring portion 42 via the nick portion 421 and goes toward the groove 342. As the receptacle connector 30 rotates, which brings along the plug connector 40 as well, the protrusion 211 proceeds with the aforementioned engagement with receptacle 30. Meanwhile the plug connector 40 cannot be unplugged from the receptacle connector 30 because the plug connector 40 is also retained by the sleeve 10.

In the rotation of the receptacle and plug connectors 30, 40 along the direction R, the protrusion 211 passes over the locking detent 344 and the plunger 20 is retained between the rotation stopper 343 and the locking detent 344. If the receptacle connector 30 is not secured on the partition, the nut 331 can alternatively backward lock the sleeve 10 to the receptacle connector 30. In other words, the nut 331 can move forward or backward for different locking purposes. Preferably, there can be more than one nut 331 (not shown in the figure) to satisfy different locking purposes.

The engagement between the receptacle connector 30 and the sleeve 10 can be reversed of course. The nut 331 is unscrewed firstly and an axial force reversed to direction R is provided to the protrusion 211 to overcome the locking detent 344 and thus being released.

Figure 6A:
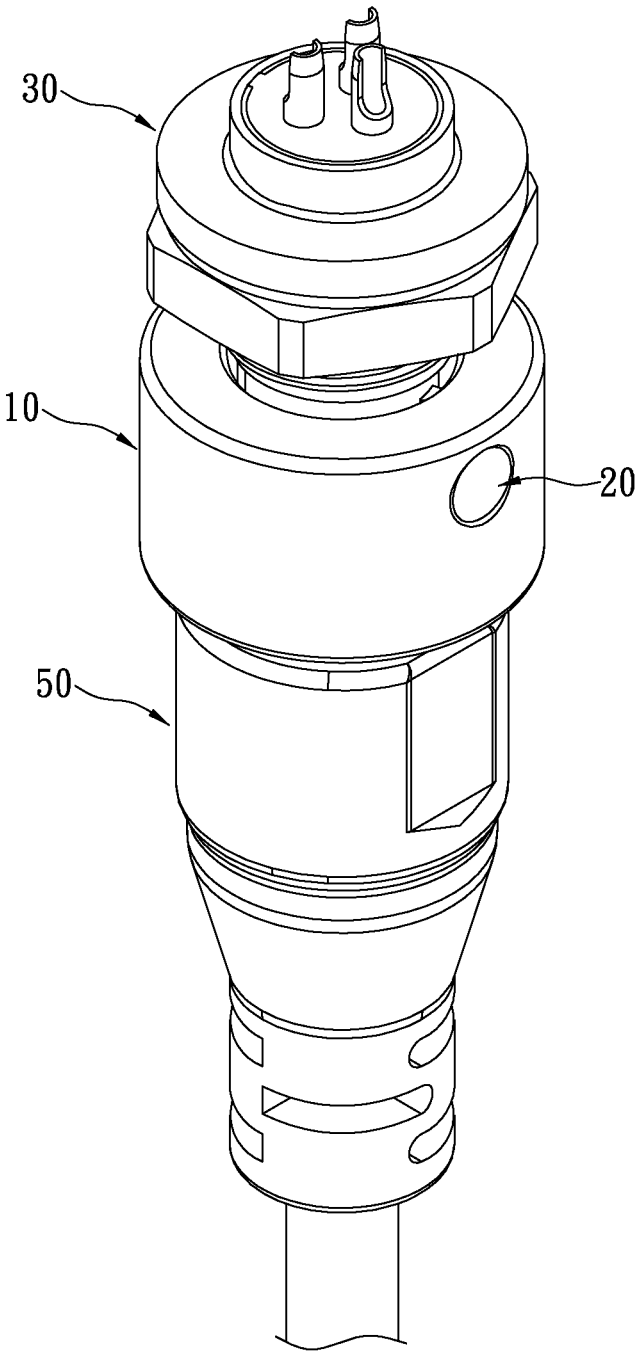
FIG. 6A illustrates a top perspective view of a spring loaded connector assembly in accordance with an embodiment of the instant disclosure.
Figure 6B:
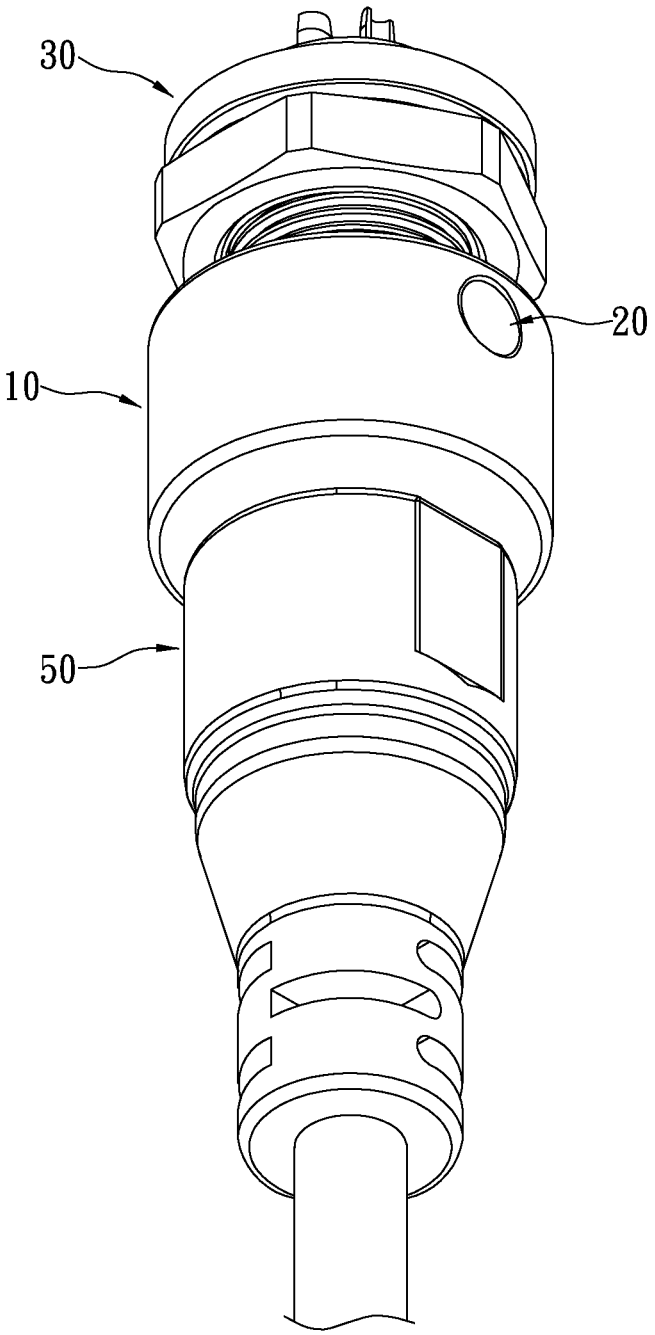
FIG. 6B illustrates a bottom perspective view of a spring loaded connector assembly in accordance with an embodiment of the instant disclosure.

Please refer to FIGS. 1, 2, 6A and 6B illustrating the cable connector with spring-loaded plunger assembly. The plug threaded portion 43 can mate with an extension threaded portion 51 of a connector extension 50 to incorporate with different connector standards.

The instant disclosure can effectively reduce the rate of units worn out by repeated connection and disconnection. The protrusion 211 and the locking detent 344 are more sustainable and are able to diminish the unit aging speed, thus prolonging the cable connector with spring-loaded plunger operation life-expectancy.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. An electrical cable connector with spring-loaded plunger comprising: a connector sleeve formed with a spring bore portion and a plug connector retaining portion at one end; and a plunger module disposed in the spring bore portion, the plunger module including a plunger slidably disposed in the spring bore portion, the plunger formed with a protrusion partially penetrating the spring bore portion toward a center of the connector sleeve, wherein the spring bore portion is a through-hole structure to accommodate the plunger module and the plunger module further includes an elastic member, a lid, a column portion formed on the plunger extending toward an opposite direction of the protrusion and a disc defining a boundary between the protrusion and the column portion, wherein the elastic member is held by the column portion, the disc abuts the spring bore portion at one end while the elastic member at the other end and the lid seals the spring bore portion to retain the plunger module therein.

2. A spring loaded electrical connector assembly, comprising: a connector sleeve formed with a spring bore portion and a plug connector retaining portion at one end;

a plunger module disposed in the spring bore portion, the plunger module including a plunger slidably disposed in the spring bore portion, the plunger formed with a protrusion partially penetrating the spring bore portion toward a center of the connector sleeve; and a receptacle connector with a front end allowing at least one cable aperture, the exterior of the receptacle connector including a nut retaining portion, a receptacle threaded portion and a plunger retaining portion, the receptacle threaded portion mating with a nut and a water proof gasket and the plunger retaining portion positioning the plunger, wherein the spring bore portion is a through-hole structure to accommodate the plunger module and the plunger module further includes an elastic member, a lid, a column portion formed on the plunger extending toward an opposite direction of the protrusion and a disc defining a boundary between the protrusion and the column portion, wherein the elastic member is held by the column portion, the disc abuts the spring bore portion at one end while the elastic member at the other end and the lid seals the spring bore portion to retain the plunger module therein.

3. The cable connector with spring-loaded plunger assembly according to claim 2, wherein the plunger retaining portion further includes a projected assembly positioning portion and a groove, the assembly positioning portion having a rotation stopper and a locking detent.

4. The cable connector with spring-loaded plunger assembly according to claim 3, wherein a plug connector is received by the receptacle connector and the sleeve, the plug connector including:

at least one cable passage communicating with the cable aperture;

a ring portion held by the plug connector retaining portion;

a plug connector water proof gasket arranged between the ring portion and the assembly positioning portion;

a plug threaded portion allowing connector extension; and a plug connector front end formed with a longitudinal slot at side.

5. The cable connector with spring-loaded plunger assembly according to claim 4, wherein the ring portion has a nick to allow the entry of the plunger.

6. The cable connector with spring-loaded plunger assembly according to claim 5, wherein the receptacle connector further includes a connector protrusion received by the slot.

* * * * *